US006175636B1

(12) United States Patent
Norris et al.

(10) Patent No.: US 6,175,636 B1
(45) Date of Patent: Jan. 16, 2001

(54) ELECTROSTATIC SPEAKER WITH MOVEABLE DIAPHRAGM EDGES

(75) Inventors: Elwood G. Norris; James J. Croft, III, both of Poway, CA (US)

(73) Assignee: American Technology Corporation, San Diego, CA (US)

( * ) Notice: Under 35 U.S.C. 154(b), the term of this patent shall be extended for 0 days.

(21) Appl. No.: 09/105,293

(22) Filed: Jun. 26, 1998

(51) Int. Cl.[7] ..... A04R 25/00

(52) U.S. Cl. ..... 381/398; 381/163; 381/386; 381/191

(58) Field of Search ..... 381/354, 163, 381/361, 176, 374, 184, 386, 191, 398

(56) References Cited

U.S. PATENT DOCUMENTS

| | | | | |
|---|---|---|---|---|
| 1,799,053 | | 3/1931 | Mache . | |
| 1,809,754 | | 6/1931 | Steedle . | |
| 1,850,855 | * | 3/1932 | Thomas . | |
| 1,983,377 | | 12/1934 | Kellogg . | |
| 2,855,467 | | 10/1958 | Curry . | |
| 2,872,532 | | 2/1959 | Buchmann . | |
| 2,935,575 | | 5/1960 | Bobb . | |
| 2,975,243 | | 3/1961 | Katella . | |
| 3,008,013 | * | 11/1961 | Williamson et al. | 381/191 |
| 3,136,867 | * | 6/1964 | Brettell | 381/191 |
| 3,345,469 | | 10/1967 | Rod . | |
| 3,373,251 | | 3/1968 | Seeler . | |
| 3,389,226 | | 6/1968 | Peabody . | |
| 3,544,733 | * | 12/1970 | Reylek | 179/111 |
| 3,654,403 | | 4/1972 | Bobb . | |
| 3,674,946 | | 7/1972 | Winey . | |
| 3,787,642 | | 1/1974 | Young, Jr. . | |
| 3,821,490 | | 6/1974 | Bobb . | |
| 3,829,623 | | 8/1974 | Willis . | |
| 3,833,771 | | 9/1974 | Collinson . | |
| 3,892,927 | | 7/1975 | Lindenberg . | |
| 3,919,499 | | 11/1975 | Winey . | |
| 3,941,946 | | 3/1976 | Kawakami . | |
| 3,997,739 | | 12/1976 | Kishikawa . | |
| 4,160,882 | | 7/1979 | Driver . | |
| 4,210,786 | | 7/1980 | Winey . | |
| 4,289,936 | | 9/1981 | Civitelto . | |
| 4,385,210 | | 5/1983 | Marquiss . | |

(List continued on next page.)

FOREIGN PATENT DOCUMENTS

2246684A * 2/1992 (GB) ..... H04R/7/06

OTHER PUBLICATIONS

Crandall, I.B. Air–Damped Vibrating System: Theoretical Calibration of the Condenser Transmitter, Phys. Rev., vol. 11 (1918) pp. 449–460.

*Primary Examiner*—Wing F. Chan
*Assistant Examiner*—Dionne Harvey
(74) *Attorney, Agent, or Firm*—Thorpe, North & Western, L.L.P.

(57) ABSTRACT

An electrostatic speaker device, comprising a first stator which is substantially acoustically transparent to audio output and a second stator spaced from the first stator at a distance which defines a charge capacitive region between the first and second stators which operates as an electrostatic field capable of driving a charge sensitive diaphragm as a speaker element. At least one charge sensitive diaphragm is sandwiched between the first and second stators and includes a conductive layer for being responsive to the electrostatic field. Support structure is coupled to at least one of the first and second stators and is attached at a portion of a perimeter of the diaphragm in a manner that imposes tension across the diaphragm to enable the first and second stators to drive the diaphragm as the speaker element. At least a portion of the diaphragm includes a diagonal which is unstressed and at least one edge unattached to allow movement at the at least one edge of the diaphragm in response to the electrostatic field for enhancement of low frequency vibration within an audio frequency range. Electrical contacts are coupled to the respective first and second stators for coupling to an audio signal source.

37 Claims, 4 Drawing Sheets

U.S. PATENT DOCUMENTS

| | | | | |
|---|---|---|---|---|
| 4,419,545 | | 12/1983 | Kuindersma . | |
| 4,471,172 | | 9/1984 | Winey . | |
| 4,480,155 | | 10/1984 | Winey . | |
| 4,550,228 | | 10/1985 | Walker et al. . | |
| 4,593,160 | | 6/1986 | Nakamura . | |
| 4,803,733 | | 2/1989 | Carver et al. . | |
| 4,885,781 | | 12/1989 | Seidel . | |
| 4,939,784 | | 7/1990 | Bruney . | |
| 5,054,081 | * | 10/1991 | West | 381/191 |
| 5,206,557 | * | 4/1993 | Bobbio | 310/339 |
| 5,392,358 | | 2/1995 | Driver . | |
| 5,430,805 | | 7/1995 | Stevenson et al. . | |

* cited by examiner

ELECTROSTATIC SPEAKER WITH MOVEABLE DIAPHRAGM EDGES

BACKGROUND OF THE INVENTION

1. Field of the Invention

This invention relates to the electrostatic speakers, and more particularly to electrostatic speakers which include a porous stator and are capable of full audio range performance.

2. Prior Art

Audio speakers typically fall within one of two categories: dynamic or magnetic driven devices and electrostatic speakers. Dynamic speakers rely on magnetic fields operating with respect to a moving cone and magnet driven by variable electromagnetic forces corresponding to the desired audio signal. Electrostatic speakers operate within much weaker, electrostatic force fields generated from a stationary stator which carries the audio signal and drives a conductive diaphragm suspended adjacent to the stator.

Electrostatic speakers have been available for decades; however, satisfactory high fidelity reproduction has been limited to very expensive systems, typically of large surface area. These limiting factors of high cost and cumbersome size have severely limited the consumer market for electrostatic speakers as part of a general sound reproduction system. This trend is contrasted by impressive advancements in dynamic speakers, both with reduction in cost and size. As a consequence, conventional dynamic speakers comprise 99% of the total domestic market. Electrostatic speakers constitute less than 1%.

The steady decline of cost of electronic components in other fields has not been matched by electrostatic design. To the contrary, these speakers remain extremely expensive. This is due in part to the large space requirement for electrostatic speakers. Because diaphragm displacement is extremely narrow, a large diaphragm is used to achieve an adequate displacement of air to develop desired amplitude, particularly at lower frequencies. In view of the required large diaphragm area, design and construction of drive systems and enclosures has tended to develop complexities in providing a uniform stator and corresponding diaphragm continuity.

One common element of electrostatic speakers is a rigid stator. The stator must be conductive to provide the variable voltage with attendant audio signal for driving the diaphragm. The rigidity of the stator is significant because the diaphragm must be maintained in a taut configuration to be fully responsive to the variations in electrostatic field strength carrying the audio signal. Any occurrence of non-uniformity in tension in the diaphragm may lead to nonlinear response in speaker output. Accordingly, the conventional stator typically bears the stress of tension applied around the total perimeter of the diaphragm.

Prior art stator elements have included rigid screens and grids, as well as perforated conductive plates. See, for example, U.S. Pat. No. 3,008,013 of Williamson et al, and U.S. Pat. No. 3,892,927 of Lindenberg. Electrical contacts are provided on the stator for coupling leads from the voltage source. Perforations or open screen and grid structure enable acoustic transparency, meaning passage of sound waves through the stator from the diaphragm to the surrounding environment. Variations in openings sizes and shapes in stator plates is clearly shown in the various patent cited above. Such plates include molded or stamped perforations which range in dimensions up to several centimeters.

The diaphragm is placed in tension across the interior surfaces of the stators to provide a surface which can vibrate as a speaker element. Numerous complex configurations are illustrated for tensing or stretching the diaphragm across the stator to realize appropriate resonant frequencies needed for predictable sound reproduction. Prior art devices have shared the common feature of full perimeter tension wherein all parts of the periphery of the diaphragm have some level of attachment with the stators which includes an element of tension or stress applied along a transverse diagonal connecting opposing diametric edges of the diaphragm.

The amount of applied tension is a function of desired resonant frequency. Because the diaphragm operates in a manner similar to a taut drum head, there exists at least one resonant frequency for the diaphragm which will tend to distort an otherwise linear response to the diaphragm as an audio speaker element. In addition to this characteristic resonant frequency, the diaphragm experiences a bass roll off effect which is associated with the diameter of the diaphragm. This is represented in FIG. 1 and occurs at a knee 10 of the response curve, dropping off at 6 db per octave. These properties of speaker diaphragms impose difficult design problems with respect to high fidelity sound reproduction within an electrostatic system.

The various patent previously cited offer different techniques for compensating for one or both of these frequency variations. For example, a U.S. patent issued to Winey isolates sections of the diaphragm with different physical dimensions to create variations in the resonant frequency for the speaker, including a high frequency strip along a length of the speaker. In a different U.S. patent issued to West, the patent teaches a similar strategy of placing damping barriers to divide the diaphragm into sections with different resonant frequencies which are selected to offset and reinforce losses associated with the referenced roll off phenomenon.

Those skilled in the art will be familiar with other limitations within electrostatic speakers which have inhibited commercialization of systems which are cost competitive with conventional dynamic speakers. The previous discussion is simply for the purpose of demonstrating representative technical difficulties which have challenged the electrostatic speaker industry. What is clear is that electrostatic speakers have been unable to keep pace with the continued expansive growth of dynamic speaker systems.

OBJECTS AND SUMMARY OF THE INVENTION

It is therefore an object the present invention to offer a new technology basis for electrostatic speakers which can provide the benefits of low cost, light weight, durability, and adaptability to a broad range of sizes, including small speaker systems useful as part of a computer or small television or stereo product.

It is also an object of the present invention to provide an electrostatic speaker which supplies a substantially continuous, uniform linear frequency response for the speaker, enabling high fidelity sound reproduction into lower frequencies of the bass audio range.

It is a further object of this invention to provide an electrostatic speaker which offers full range of audio output with enhanced linearity within low frequency ranges.

Yet another object of this invention includes provision of an electrostatic speaker which is light in weight, yet able to produce commercially acceptable low frequency output.

These and other objects are realized in an electrostatic speaker device comprising an electrostatic speaker device, comprising a first stator which is substantially acoustically transparent and a second stator spaced from the first stator at a distance which defines a charge capacitive region between the first and second stators which operates as an electrostatic field capable of driving a charge sensitive diaphragm as a speaker element. At least one charge sensitive diaphragm is sandwiched between the first and second stators and has a conductive layer for being responsive to the electrostatic field. Support structure is coupled to at least one of the first and second stators, and is attached at a portion of a perimeter of the diaphragm in a manner that imposes tension across the diaphragm to enable the first and second stators to drive the diaphragm as the speaker element. At least a portion of the diaphragm includes a diagonal which is unstressed with at least one edge unattached to allow movement at the at least one edge of the diaphragm in response to the electrostatic field for enhancement of low frequency vibration within an audio frequency range. Electrical contacts coupled to the respective first and second stators enable coupling to an audio signal source.

The use of two or more diaphragm members is disclosed, and includes a bias charge which repels the several diaphragm members from each other. A single diaphragm can be folded against itself to provide this multilayered structure. The diaphragms may be suspended between the respective stators, or may be supported directly on the stator surfaces. Specific configurations of diaphragms are provided, including diaphragm structure having at least one diagonal without an applied tension to increase bass performance and substantially lower resonant frequencies.

Other objects and features will be apparent to those skilled in the art, based on the following detailed description, taken in combination with the accompanying drawings.

DESCRIPTION OF THE PREFERRED EMBODIMENTS

Figure 1:
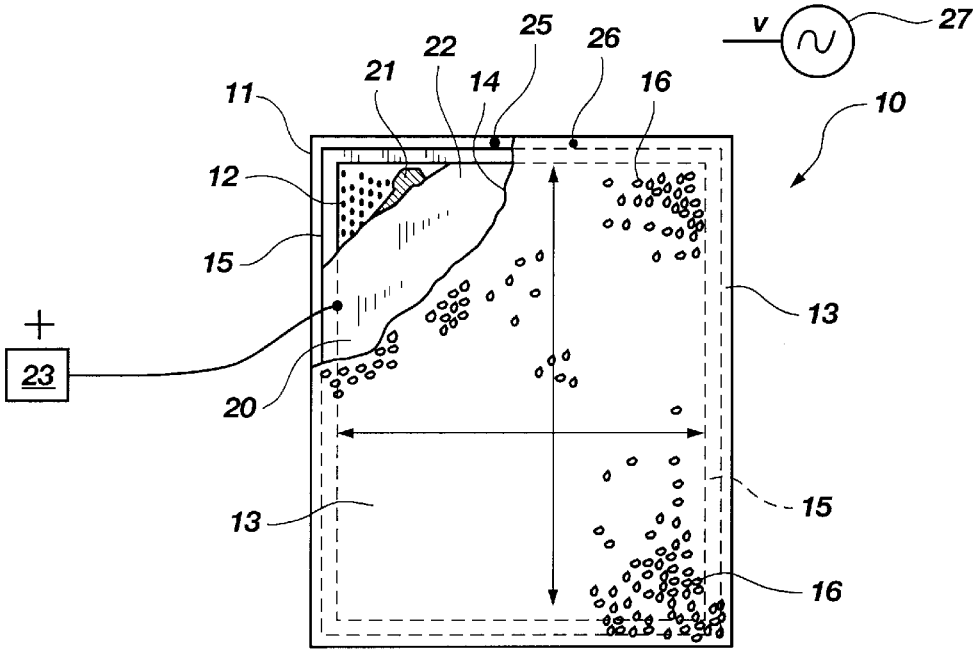
FIG. 1 is a plan view of an electrostatic speaker constructed in accordance with the present invention.
Figure 2:
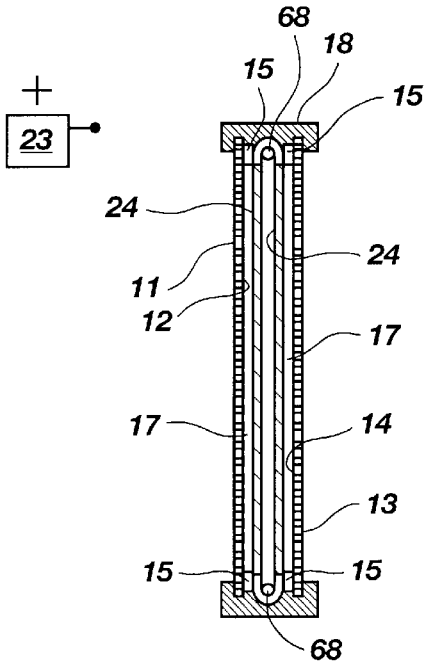
FIG. 2 shows a cross-sectional view of an embodiment similar to FIG. 1, but having two diaphragm members instead of a single diaphragm.
Figure 5:
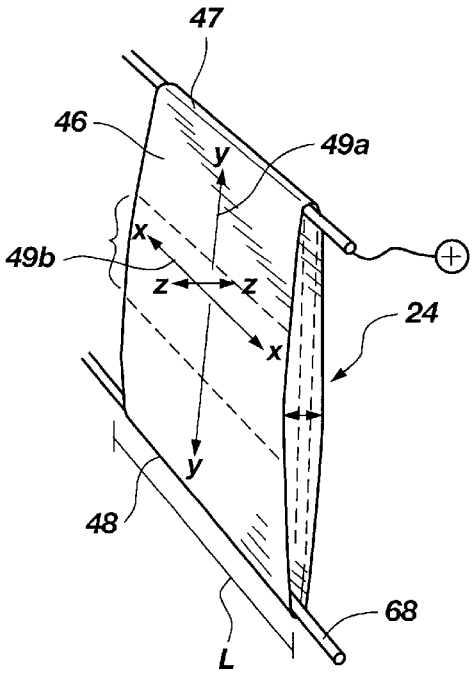
FIG. 5 illustrates an isolated view of a diaphragm suspended with an unstressed diagonal section for enhanced low frequency response.

FIGS. 1, 2 and 5 illustrate the basic construction of an electrostatic speaker using a conductive grid, wire or metal plate as a stator member. It is important to note that the stator function requires this member to remain stationary while vibrating a flexible diaphragm for sound reproduction. Indeed, the term "stator" is derived from the same root term represented by this characteristic of stationary function. Therefore, any conventional conductive grid that provides acoustic transparency and offers required rigidity can be configured as a stator for purposes of the present invention.

FIG. 1 shows an electrostatic speaker device 10 having a first rigid stator 11 with an interior surface 12. A second stator 13 having a comparable interior surface 14 is positioned adjacent to the interior surface of the first stator. Both stator members 11 and 13 are comprised of conductive material which enables the development of a charge capacitive region between the respective interior faces 12 and 14. Each stator has numerous small perforation 16 to provide the desired acoustic transparency.

The establishment of a charge capacitance between the respective interior faces of the stators enables use of at least one diaphragm 20 disposed between the first and second stators as a vibrating speaker element. The diaphragm 20 includes a dielectric layer 21 of material such as Kapton® or Mylar®, and an electrically conductive layer 22 responsive to electrostatic forces developed by the respective first and second stators. Multiple diaphragms may be used in stacked configuration. This diaphragm is suspended between the stators 11 and 13, free of contact with the conductive interior faces of the stators. A strip of insulation 15 positioned around the perimeter of the diaphragm will shield edges of the diaphragm and stators from arcing. The use of double sided adhesive tape may be used to fix the diaphragm in tension across the stator, as well as provide appropriate insulation at the perimeter.

FIG. 2 shows a double diaphragm in side, cutaway view, suspended away from the interior stator surfaces for allowing larger displacement for low frequencies. The stators 11 and 13 are supported in a clamp or frame member 18. Perforations 16 are shown in the stators for sound transmission. The interior surfaces 12 and 14 of the stators provide a conductive surface suitable for uniform charge distribution as part of the electrostatic speaker system. An insulative spacer 15 displaces the diaphragm 24 away from the conductive surfaces 12 and 14, and also shields the edges of the diaphragm from arcing to the stators. This displacement provides a gap 17 to permit movement of the diaphragm as the speaker element as part of a charge capacitive transducer.

The operation of the illustrated charge capacitive device is comparable to electrostatic speaker systems. Accordingly, a charge source 23 for providing an electrical charge on the at least one diaphragm is provided for biasing the diaphragm. In addition, electrical contacts 25 and 26 are coupled to the first and second stators for attachment to a signal source 27 operable to supply voltage at the respective first and second stators to provide a push-pull drive configuration for the at least one diaphragm as an active speaker element. These electrical components are well known in the industry.

Figure 3:
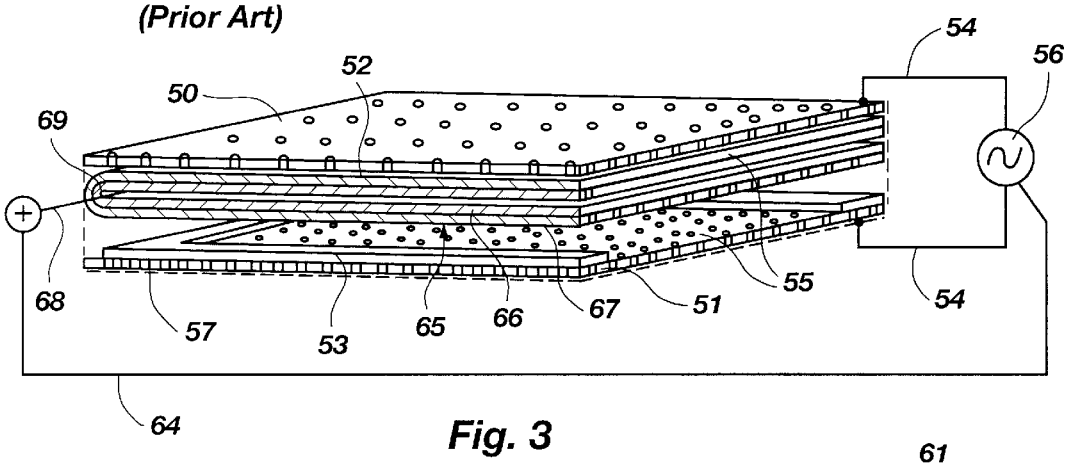
FIG. 3 is an elevational perspective view of a partially exploded speaker system.

FIG. 3 illustrates an electrostatic speaker device wherein a single sheet of metalized Mylar 65 provides two diaphragm members suspended between opposing rigid grids 50 and 51. These grids form conductive stators which may include an insulative coating 57 at an exterior surface. An insulating frame 52 and 53 spaces the diaphragm members from the stators. At least one edge 55 is unclamped and remains free to move in response to applied audio signal 56 through contacts 54. As is discussed in greater detail hereafter, this free end of the diaphragm allows for a reduction in the resonant frequency of the diaphragm as well as providing greater displacement of air.

Figure 4A:
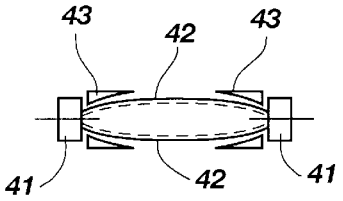
Fig. 4a (Prior Art)
FIGS. 4*a* and 4*b* graphically illustrate a comparison of diaphragm movement in prior art versus present invention relationship.
Figure 4B:
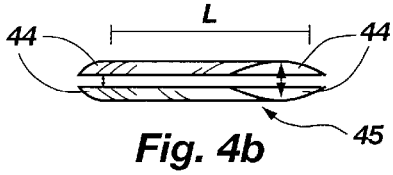

For example, FIG. 4*a* shows a conventional clamping 41 of the diaphragm 42 at the edges, limiting movement to the central portion. In this condition, spacial volumes 41 remain inactive, wasting potential air displacement and reducing amplitude of audio output. In FIG. 4*b,* the edges 44 are free to move up and down, uniformly across the full width L of the diaphragm 45. FIG. 5 illustrates this feature with a diaphragm 46 which suspended in tension at diametrically opposing edges 47 and 48. This direction for force or tension is indicated at 49*a* and extends in the Y direction. In contrast, the X direction 49*b* represents a diagonal of the diaphragm which is without stress or applied tension. This allows the diaphragm to vibrate in the Z axis across the full width L.

Although rectangular configurations are illustrated, those skilled in the art will appreciate that other orientations and diagonal combinations may be applied to accomplish similar purposes. Accordingly, at least a portion of the perimeter of the diaphragm is in an unstressed condition along at least one diameter across the diaphragm. The rectangular configuration of the speaker device, however, is a preferred shape for application of this unstressed factor because of the simplicity of applying a uniform tension across the width of the diaphragm. Specifically, a rectangle having two opposing edges of the diaphragm clamped in tension, and a remaining two opposing edges unclamped and without transverse tension between the unclamped opposing edges enables movement of a full width of the diaphragm including the unclamped edges for enhancement of low frequencies.

Figure 6:
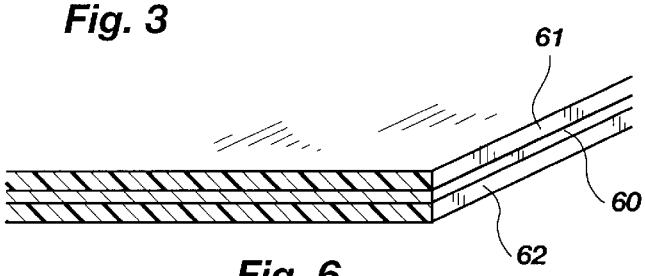
FIG. 6 depicts an integrated diaphragm useful in the present speaker system.

As is illustrated in the Figures, either single or multiple diaphragm members may incorporate this unstressed diaphragm concept as part of the vibrating speaker element. FIG. 6 shows a diaphragm comprises of a single electrically conductive layer 60 sandwiched between two opposing dielectric layers 61 and 62 which are integrally formed as a single diaphragm. The respective opposing dielectric layers provide insulative material between the conductive layer and the conductive stators. This constriction provide significant versatility for either a suspended application, or diaphragm to be physically supported at a conductive stator face. It avoids the need for separate use of insulative material between the conductive diaphragm layer and the stators.

Figure 7:
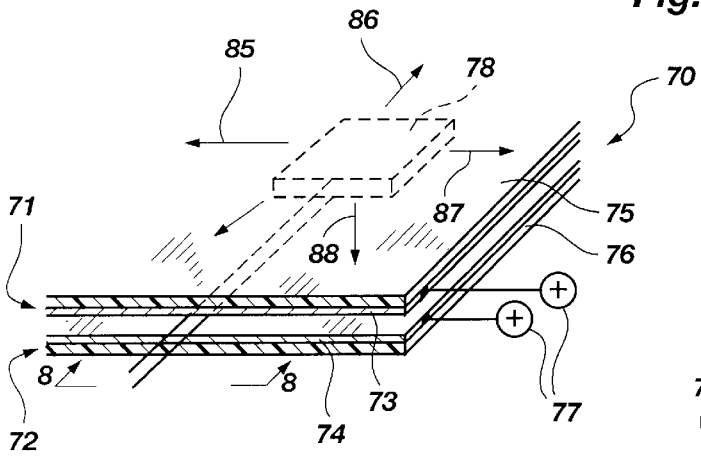
FIG. 7 shows an embodiment which includes a damping member for modification of resonant frequency values across the diaphragm.
Figure 8:
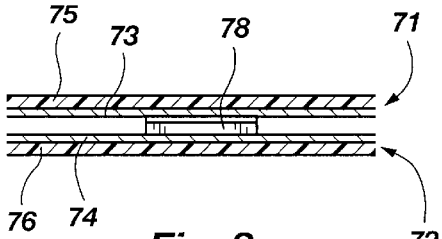
FIG. 8 is a cross-sectional view taken along the lines 8—8 of FIG. 7.

Another version shown in FIGS. 7 and 8 illustrates the diaphragm 70 as two separate diaphragms 71 and 72 each having a dielectric layer 73 and 74 and a conductive layer 75 and 76 applied to the dielectric layer. The two separate diaphragms 71 and 72 may be positioned with the conductive layers in juxtaposed, facing relationship, with the dielectric layers providing insulation of the conductive layer from the stators. This device including means 77 for biasing the respective conductive layers in spaced apart relation during operation. A spacer element 78 is shown inserted for damping purposes, and also to provide for modifying the collective resonant frequency of the diaphragm as will be explained hereafter.

FIG. 3 also illustrates an alternate diaphragm configuration wherein a single metalized Mylar diaphragm 65 is used in combination with a biasing support wire 68. In this embodiment, the diaphragm comprises a metalized layer 66 which is in direct electrical contact with the bias wire 69. The outer Mylar layer 67 provides insulation from the conductive stators 50 and 51. The biasing support wire 69 includes means 64 for coupling to a biasing circuit, which in this case includes a tap from the audio output signal. The biasing wire 68 provides an electrical contact positioned along and in physical contact with the common edge 69 of the continuous diaphragm. Specifically, the electrical contact comprises an exposed conductive element 68 which provides contact support for the folded conductive layer 69 of the single diaphragm 65 to thereby (i) provide a support member for the diaphragm to wrap around at the common edge, and (ii) establish electrical contact along the common edge to facilitate uniform charge dispersion on the diaphragm. It should be apparent that other diaphragm configurations are contemplated for use with the conductive stator as provided by this invention.

Figure 9:
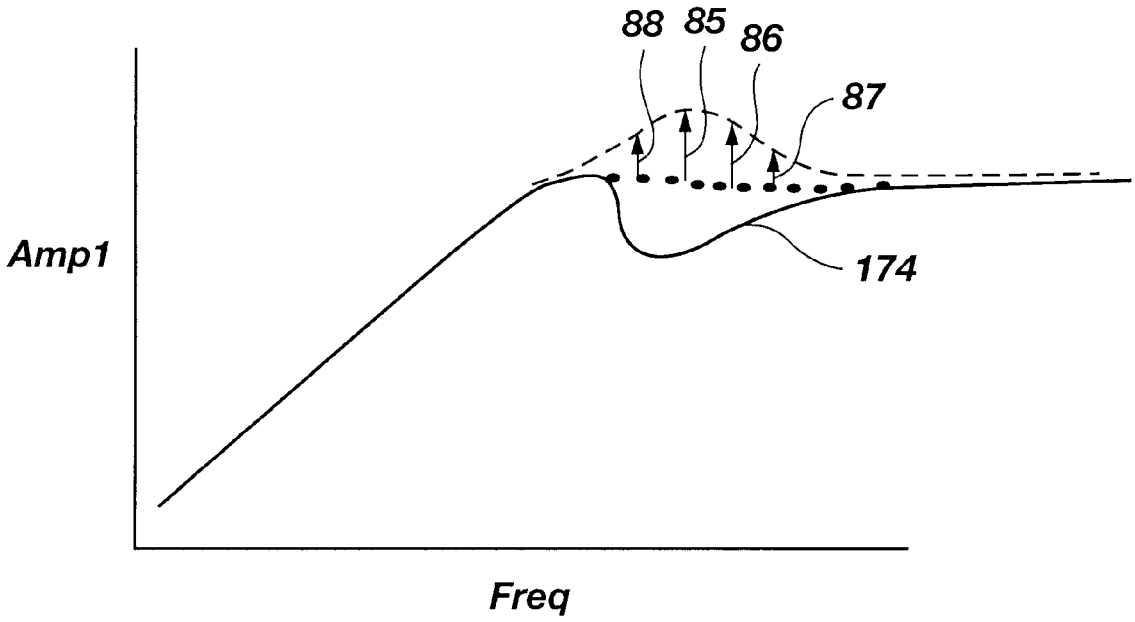
FIG. 9 graphically illustrates equalization of low frequency response.

Another useful technique for modifying resonant frequency for the subject invention involves application of a damping insert as shown in FIGS. 7 and 8. Whereas prior art techniques have segmented and isolated sections of diaphragm to develop different resonant frequencies, the present invention integrates a variety of different resonant frequencies by permitting 360 of free diaphragm movement around the damping element 78. Instead of relying on independent diaphragm sectors to equalize bass roll-off, the present invention develops an interdependent relationship wherein the full diaphragm acts like a drum head, having varying tension around the perimeter of the insert. The diaphragm is literally tuned to enhance lost bass signal by incorporating several interdependent resonant frequencies as shown in FIG. 9. For illustration only, the orientations 85, 86, 87, and 88 represent a selection of numerous interdependent resonant frequencies which cooperate to minimize bass loss 84 represented on the graph of FIG. 9.

Figure 10:
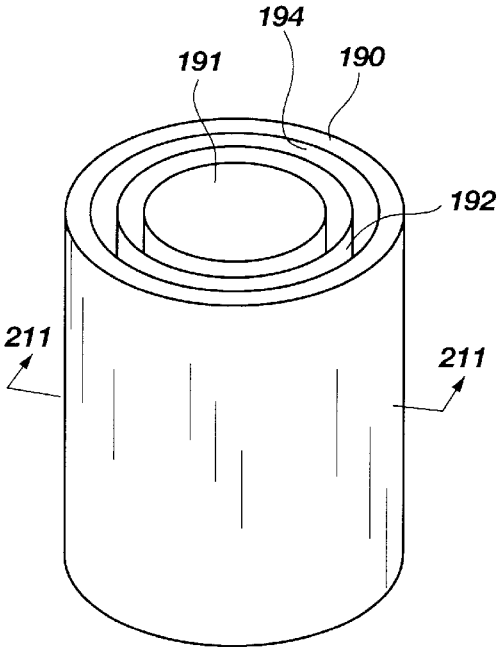
FIG. 10 illustrates an elevational view of a speaker system comprising concentric cylinders.

The polarity and insulative sides of the foam members may be reversed so that the forward face of the foam is insulated, and the emitter film contacting face is conductive. Such a device is illustrated in FIG. 10 as a cylindrical speaker. The device comprises an electrostatic emitter film 192 which is responsive to an applied variable voltage to emit sonic output based on a desired sonic signal. A first foam member 190 having a forward face, an intermediate core section and a rear face as described above is positioned on the exterior and includes open cell structure to transmit sound. The first foam member including a composition having sufficient stiffness to support the electrostatic film and including conductive properties which enable application of a variable voltage to supply the desired sonic signal. The first forward face 194 comprises a surface including small cavities having surrounding wall structure defining each cavity, the surrounding wall structure terminating at contacting edges approximately coincident with the forward face of the foam member. This forward face 194 has a coating of insulative material to prevent arcing from the voltage within the intermediate foam section and the film 192. A second foam member 191 of comparable configuration in opposing orientations is provided to complement the push-pull construction. This foam may be partial open cell and partial closed cell to dampen rearward sound transmission. An insulation barrier be provided on an adjacent side of the film (metalized surface), or at the second forward face of the stator 191. Sound propagation would therefore be oriented radiated outward from the cylinder, reinforced by the dynamic affect of both stator elements. Insulating means is positioned between the electrostatic emitter film and the conductive composition of the first foam member which has the conducive properties.

Figure 11:
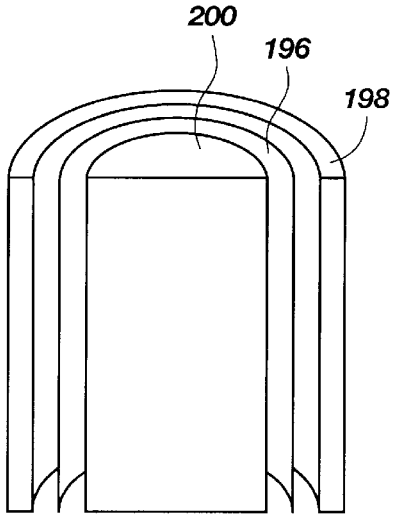
FIG. 11 is a cross sectional view taken along the lines 211—211 of FIG. 10.

A variation of the foam member would be a more general support member as shown in FIG. 11. In this embodiment, the device includes an electrostatic emitter film 196 responsive to a variable voltage to emit sonic output based on a desired sonic signal. A support member 198 having a forward face, an intermediate core section and a rear face is formed of a conductive material which includes a forward face composed of a composition having sufficient stiffness to support the electrostatic film and including conductive properties which enable application of a variable voltage to the forward face to supply the desired sonic signal. The forward face comprises a generally pitted surface including small cavities having surrounding wall structure defining each cavity, said surrounding wall structure terminating at a contacting edges approximately coincident with the forward face of the support member. This may be in the form of a metal or expanded metal material which operates in a manner similar to the foam structure. Hereagain, the conductive and insulative surfaces could be reversed as explained above. A push-pull configuration is provided by the second support member 200.

Figure 12:
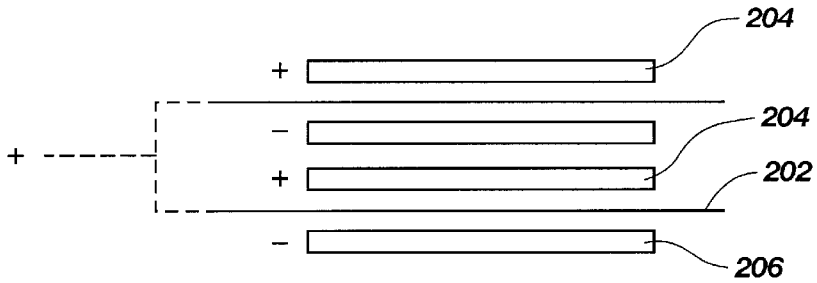
FIG. 12 graphically depicts a multilayered speaker array of alternating stators and emitter films.

FIG. 12 illustrates the use of multiple emitter film 202, sandwiched between foam or general support members 204, 206. Each additional emitter film will add approximately 3 db output to the emitted sonic signal. It will be apparent that numerous configurations can be adapted within this multiple combination pattern.

It will be apparent to those skilled in the art that the foregoing description of preferred embodiments is not intended to limit other applications of the inventive principles disclosed herein. Accordingly, other variations will be apparent and are intended to be comprehended within the following claims.

What is claimed is:

1. An electrostatic speaker device, comprising:

a first stator which has a substantially acoustically transparent portion;

a second stator spaced from the first stator at a distance which defines a charge capacitive region between the first and second stators which operates as an electrostatic field capable of driving a charge sensitive diaphragm as a speaker element, the first and second stators being configured for push-pull operation to provide enhanced linearity within low frequency ranges;

at least one charge sensitive diaphragm spaced from and sandwiched between the first and second stators and having a conductive layer for being responsive to the electrostatic field;

support structure coupled to at least one of the first and second stators, said support structure being attached at a portion of a perimeter of the diaphragm in a manner that imposes tension across the diaphragm and orients the diaphragm substantially parallel to the acoustically transparent portion of the first and second stators, to enable the first and second stators to drive the diaphragm as the speaker element;

at least a portion of the diaphragm being spaced from the first and second stators sufficient to avoid contact between the diaphragm and stators during operation at the low frequency ranges and including a diagonal which is unstressed at at least one edge to allow movement at the at least one edge of the diaphragm in response to the electrostatic field for enhancement of low frequency vibration within an audio frequency range, and electrical contacts coupled to the respective first and second stators for coupling an audio signal source.

2. A device as defined in claim 1, wherein the diaphragm comprises at least two conductive layers disposed in juxtaposed, face-to-face relationship and being cooperatively responsive to the electrostatic field to provide audio output as part of a push-pull speaker system.

3. A device as defined in claim 2, wherein the at least two conductive layers are supported on a common support structure at the portion of the perimeter.

4. A device as defined in claim 3, wherein the common support structure comprises an elongate support arm having a uniform diameter along a supporting length of the support arm which defines a uniform separation distance between the at least two conductive layers of the diaphragm.

5. A device as defined in claim 4, wherein the uniform separation distance is sufficient to permit juxtaposed edges of the at least two conductive layers to vibrate at least one audio frequency without adverse contact between the juxtaposed edges.

6. A device as defined in claim 5, wherein the juxtaposed edges are configured to vibrate at a common frequency and in phase.

7. A device as defined in claim 6, wherein the common frequency is within the frequency range between 20 Hertz and 5000 Hertz.

8. A device as defined in claim 7, wherein the common frequency is less than 1000 Hertz.

9. A device as defined in claim 2, further comprising a voltage source coupled to the at least two conductive layers including the juxtaposed edges of the diaphragm to provide a charge of common polarity on each layer to cause the respective two layers to repel into a separated relationship.

10. A device as defined in claim 1, wherein respective interior surfaces of the first and second stators are electrically conductive, said device further comprising an insulative frame portion coupled to the first and second stators and extending around an interior perimeter at the respective interior surfaces of the first and second stators to prevent arcing between the edges of the diaphragm and the conductive surfaces of the stators.

11. A device as defined in claim 1, wherein the diaphragm includes a diaphragm perimeter positioned between the respective insulative frame portions, said diaphragm including an insulative layer between the conductive layer and the interior conductive surfaces of the first and second stators to prevent arcing therebetween.

12. A device as defined in claim 1, further comprising a clamping structure at least two opposing edges of the diaphragm to maintain the diaphragm in sufficient tension along at least one diagonal of the diaphragm between the first and second stators to enable propagation of audio pressure waves.

13. A device as defined in claim 12, wherein the clamping structure is applied to a first set of diametric opposing edges of the diaphragm, at least one remaining set of diametric opposing edges of the diaphragm being unclamped to permit responsive movement of opposing edges of the diaphragm within the electrostatic field.

14. A device as defined in claim 13, wherein the diaphragm is configured as a rectangle having two opposing edges of the diaphragm clamped in tension, and two remaining opposing edges unclamped and without transverse tension between the unclamped opposing edges to thereby enable movement of the unclamped edges with an interior section of the diaphragm.

15. A device as defined in claim 14, wherein the diaphragm comprises at least two conductive layers disposed in juxtaposed, face-to-face relationship and being cooperatively responsive to the electrostatic field to provide audio output as part of a push-pull speaker system.

16. A device as defined in claim 15, wherein the at least two conductive layers are supported on a common support structure at the portion of the perimeter.

17. A device as defined in claim 16, wherein the common support structure comprises an elongate support arm having a uniform diameter along a supporting length of the support arm which defines a uniform separation distance between the at least two conductive layers of the diaphragm.

18. A device as defined in claim 17, wherein the uniform separation distance is sufficient to permit juxtaposed edges of the at least two conductive layers to vibrate at least one audio frequency without adverse contact between the juxtaposed edges.

19. A device as defined in claim 1, wherein the first and second stators are bowed with respect to each other to form a contained volume therebetween which has an increasing separation distance from a perimeter of the device toward a central portion of the device, providing a central region for maximum displacement of the diaphragm.

20. An electrostatic speaker device as defined in claim 1, wherein the interior surfaces of the respective first and second stators are electrically conductive and exterior surfaces of the respective stators are nonconductive.

21. An electrostatic speaker device as defined in claim 1, wherein the first and second stators are comprised of a metal grid having a thickness within a range of approximately of 1 mm to 5 mm.

22. An electrostatic device as defined in claim 1, wherein the diaphragm is sandwiched between the respective first and second stators.

23. An electrostatic speaker device as defined in claim 1, wherein the diaphragm is spaced at a static distance from the respective first and second stators to enable dynamic oscillation of the diaphragm without contact interference with interior surfaces of the stators.

24. An electrostatic speaker device as defined in claim 1, wherein the diaphragm comprises a single electrically conductive layer sandwiched between two opposing dielectric layers which are integrally formed as a single diaphragm, said respective opposing dielectric layers providing insulative material between the conductive layer and the conductive stators.

25. An electrostatic speaker device as defined in claim 1, wherein the diaphragm comprises two separate diaphragms each having a dielectric layer and a conductive layer applied to the dielectric layer; said two separate diaphragms being positioned with the conductive layers in juxtaposed, facing relationship, said dielectric layers providing insulation of the conductive layer from the stators, said device including means for biasing the respective conductive layers in spaced apart relation during operation.

26. An electrostatic speaker device as defined in claim 25, wherein the respective conductive layers include electrical contacts for coupling to a biasing circuit for applying a biasing signal of common polarity to repel the conductive layers to the spaced apart relation.

27. An electrostatic speaker device as defined in claim 26, further comprising audio circuitry coupled to the respective stators to provide audio signal for driving the two diaphragms to generate audio compression waves, said device further comprising biasing means coupled between the audio circuitry and the respective two diaphragms for extracting voltage from the audio signal as the biasing signal.

28. An electrostatic speaker device as defined in claim 2, wherein the two separate diaphragms are formed of a single diaphragm comprising a conductive layer and a dielectric layer, said single diaphragm being centrally folded upon itself to form a common edge of continuous diaphragm, said conductive layers being juxtaposed in face to face configuration.

29. An electrostatic speaker device as defined in claim 28, wherein the electrical contacts for coupling to a biasing circuit comprise an electrical contact positioned along and in physical contact with the common edge of the continuous diaphragm.

30. An electrostatic speaker device as defined in claim 29, wherein the electrical contact comprises an exposed conductive element which provides contact support for the folded conductive layer of the single diaphragm to thereby (i) provide a support member for the diaphragm to wrap around at the common edge, and (ii) establish electrical contact along the common edge to facilitate uniform charge dispersion on the diaphragm.

31. An electrostatic speaker device comprising:

a first stator which is substantially acoustically transparent and includes an electrically conductive first interior surface;

an insulative surface positioned around a perimeter of the first interior surface;

a first electrically conductive diaphragm spaced from the first stator and supported in tension at diametric portions of the insulative surface, said diaphragm including at least one diametric portion which is unsupported and includes at least one edge of the diaphragm which is free to move in oscillation with a central portion of the diaphragm;

a second stator which is substantially acoustically transparent and includes an electrically conductive second interior surface;

an insulative surface positioned around a perimeter of the second interior surface;

a second electrically conductive diaphragm spaced from the second stator and supported in tension at diametric portions of the insulative surface and in corresponding orientation with the diametric portions of the first diaphragm, said diaphragm including at least one diametric portion which is unsupported and includes at least one edge of the diaphragm which is free to move in oscillation with a central portion of the diaphragm, said unsupported diametric portion be commonly oriented with the unsupported diametric portion of the first diaphragm;

a spacing member positioned around the perimeter of the first and second interior surfaces and having a thickness which corresponds to a desired separation distance which defines a charge capacitive region between the respective first and second stators which is dimensioned to provide space for the respective first and second diaphragms to vibrate as push-pull speaker elements in response to an audio signal imposed at the first and second stators;

said first and second stators including electrical contacts for receiving the audio signal from a signal source; and an electrical contact on the first and second diaphragms for receiving a biasing charge to enable the first and second diaphragms to vibrate as the speaker elements of the electrostatic speaker device.

32. An electrostatic speaker device as defined in claim 2, further comprising a damping member inserted between the two diaphragms, said damping member having a perimeter fully surrounded by open diaphragm space to enable interdependent modification of resonant frequency of the surrounding diaphragm through 360 degrees.

33. An electrostatic speaker device as defined in claim 32, wherein the damping member is positioned such that at least one bass resonant frequency operates to reinforce a portion of frequency loss occurring by reason of bass roll off loss at a corresponding frequency value.

34. An electrostatic speaker device as defined in claim 33, the damping member is positioned such that a variety of different resonant frequencies are developed in surrounding diaphragm over a full range of 360 degrees surrounding the damping member for at least partially leveling frequency response in a portion of the bass roll off.

35. An electrostatic speaker device as in claim 1 wherein the diaphragm is one continuous loop which is tensioned to form two juxtaposed diaphragms.

36. An electrostatic speaker device as in claim 1 wherein the diaphragm is folded in at least two parts and tensioned to form two juxtaposed diaphragms.

37. An electrostatic speaker device as in claim 1 wherein the diaphragm is folded in at least two parts and tensioned to form at least two diametrically juxtaposed diaphragms.

* * * * *